US005693120A

United States Patent [19]

Obana et al.

[11] Patent Number: 5,693,120

[45] Date of Patent: Dec. 2, 1997

[54] PRODUCTION METHOD FOR LOW CARBON MOLTEN STEEL USING VACUUM DEGASSING AND DECARBURIZATION TREATMENT

[75] Inventors: Yasuo Obana; Koichi Endoh; Makoto Moriguchi; Toshihiko Kaku; Shigenori Yagura; Fumio Hayashi, all of Oita, Japan

[73] Assignee: Nippon Steel Corporation, Tokyo, Japan

[21] Appl. No.: 553,708

[22] PCT Filed: Jun. 6, 1994

[86] PCT No.: PCT/JP94/00911

§ 371 Date: Dec. 1, 1995

§ 102(e) Date: Dec. 1, 1995

[87] PCT Pub. No.: WO94/29488

PCT Pub. Date: Dec. 22, 1994

[30] Foreign Application Priority Data

Jun. 4, 1993 [JP] Japan ..... 5-134333

[51] Int. Cl.[6] ..... C21C 7/10

[52] U.S. Cl. ..... 75/384; 75/511; 75/512

[58] Field of Search ..... 75/511, 512, 384

[56] References Cited

U.S. PATENT DOCUMENTS 4,071,356 1/1978 Yamamoto et al. ..... 75/511

FOREIGN PATENT DOCUMENTS 61-19727 1/1986 Japan .
63-111116 5/1988 Japan .
3-61317 3/1991 Japan .
901298 1/1982 U.S.S.R. ..... 75/512

OTHER PUBLICATIONS

Patent Abstracts Of Japan, vol. 12, No. 353 (C-530), Sep. 21, 1988 & JP-A-63 111116 (Sumitomo Metla Ind. Ltd.), May 16, 1988.

Patent Abstracts Of Japan, vol. 15, No. 211 (C-836), May 29, 1991 & JP-A-03 061317 (NKK Corp.), Mar. 18, 1991.

Patent Abstracts Of Japan, vol. 10, No. 166 (C-353), Jun. 13, 1986 & JP-A-61 019727 (Sumitomo Kinzoku Kogyo K.K.), Jan. 28, 1986.

*Primary Examiner*—Melvyn Andrews
*Attorney, Agent, or Firm*—Kenyon & Kenyon

[57] ABSTRACT

In a vacuum degassing and decarburization treatment, the present invention uses a $CO_2$ gas as a recirculating gas and as a stirring gas without inviting stoppage of decarburization and an increase in the carbon concentration and moreover, without an increase in the amount of addition of an alloy, and can reduce the gas cost. The present invention provides a production method for a low carbon molten steel which comprises blowing a $CO_2$ gas from the start of degassing treatment till the carbon concentration of the molten steel reaches 50 ppm in vacuum degassing and decarburization treatment of the molten steel, and thereafter blowing an Ar gas.

6 Claims, 8 Drawing Sheets

PRODUCTION METHOD FOR LOW CARBON MOLTEN STEEL USING VACUUM DEGASSING AND DECARBURIZATION TREATMENT

TECHNICAL FIELD

This invention relates to a vacuum degassing and decarburization treatment for a molten steel using a vacuum degassing equipment, and more particularly to a production method, for a low carbon molten steel, which is advantageous from the aspects of cost of production and high efficiency, using a vacuum degassing and decarburization treatment which improves the recirculating or stirring gas for a molten steel.

BACKGROUND ART

A method which exposes a molten steel to a reduced pressure by using vacuum treatment equipment (for example, RH, DH, etc.) is known as a method of degassing and decarburizing a molten steel according to the prior art. This method is a decarburization treatment method which promotes the reaction $C+1/2\ O_2 \rightarrow CO$ by reducing the pressure. The vacuum treatment equipment includes a lance and/or a twyer for blowing an Ar gas into the molten steel so as to recirculate or stir the molten steel and to promote the treatment, a double twyer for simultaneously blowing oxygen necessary for deoxidization and Ar for cooling it, and a lance and/or a twyer for blowing Ar into the molten steel so as to stir the molten steel by the resulting fine bubbles, and to promote the treatment by increasing the area of the reaction interface.

FIG. 8 shows these members of an RH vacuum treatment equipment, by way of example. In the drawing, reference numeral 27 denotes an Ar gas blast twyer for recirculating the molten steel between a molten steel ladle 21 and a vacuum degassing vessel 29, reference numeral 28 denotes an Ar gas blast twyer for stirring the molten steel, reference numeral 24 denotes an Ar gas blast twyer for recirculating the molten steel between the molten steel ladle 21 and the vacuum degassing vessel 29, and reference numeral 30 denotes a double twyer for simultaneously blowing oxygen necessary for decarburization from an inner pipe and an Ar gas for cooling the inner pipe and a refractory around the inner pipe from an outer pipe. Because the Ar gas is blown from these lances and/or twyers, vacuum degassing and decarburization treatment can be promoted.

However, there remains the problem that because Ar is extremely expensive, the production cost of the molten metal is high.

In contrast, as a method of reducing the cost by simultaneously blowing oxygen necessary for decarburizing the molten steel inside the vacuum treatment equipment and the Ar gas necessary for cooling it into the molten steel by using a double pipe, Japanese Unexamined Patent Publication (Kokai) No. 56-44711 discloses a method which blows a $CO_2$ gas during treatment by using a single pipe in place of the double pipe. This is the method which vacuum decarburizes the molten steel by the endothermic reaction $C+CO_2 \rightarrow 2CO$. According to the observation made by the inventors of the present invention, however, it has been found out that the decarburization reaction does not proceed below a certain carbon concentration of the molten steel even when the $CO_2$ gas is blown into the molten steel, and a low carbon steel having a carbon concentration of below 50 (ppm) cannot be produced. It has further been found out that when a deoxidizing alloy such as Al or Si is added to the molten steel inside the vacuum treatment equipment, the oxygen concentration increases, on the contrary, when $CO_2$ is continuously blown into the molten steel even after the addition of this alloy, so that an excessive amount of the alloy must be added to remove this oxygen, and the resulting fine oxides deteriorate the cleanness of the molten steel.

DISCLOSURE OF INVENTION

The present invention has been completed in view of the problems described above, and the gist of the present invention resides in the following points.

1. In a vaccum degassing and decarburization treatment method for a molten steel using a vacuum treatment equipment provided with a lance and/or a twyer capable of blowing a gas into the molten steel and by blowing the gas from the lance and/or the twyer, a production method for a low carbon molten steel characterized in that $CO_2$ gas is blown from an initial stage, a vacuum degassing and decarburization treatment is carried out by recirculating or stirring the molten steel by CO gas generated by decomposition of the $CO_2$ gas, and the $CO_2$ gas is switched to an Ar gas as soon as the carbon concentration of the molten steel reaches a range where decarburization becomes slow.

2. In a vacuum degassing and decarburization treatment method for a molten steel using a vacuum treatment equipment provided with a lance and/or a twyer capable of blowing a gas into the molten steel and by blowing an Ar gas from the lance and/or the twyer, a production method for a low carbon molten steel having a carbon concentration of not higher than 50 (ppm) characterized in that vacuum degassing and decarburization treatment of the molten steel is carried out by switching the Ar gas to be blown from the lance and/or the twyer to $CO_2$ gas for a certain period of time at the stage where the carbon concentration of the molten steel is higher than 50 (ppm), and is carried out by blowing only the Ar gas at the stage where the carbon concentration of the molten steel is not higher than 50 (ppm).

3. In a vacuum degassing and decarburization treatment method for a molten steel using a vacuum treatment equipment provided with a lance and/or a twyer capable of blowing a gas into the molten steel and by blowing the gas from the lance and/or the twyer, a production method for a low carbon molten steel characterized in that vacuum degassing and decarburization treatment is carried out by blowing $CO_2$ gas into the molten steel from the lance and/or the twyer from the start of the vacuum degassing and decarburization treatment of the molten steel, and the $CO_2$ gas is switched to Ar gas before the carbon concentration of the molten steel reaches 50 (ppm).

4. In a vacuum degassing and decarburization treatment method for a molten steel using a vacuum treatment equipment provided with a lance and/or a twyer capable of blowing a gas into the molten steel and by blowing the gas from the lance and/or the twyer, a production method for a low carbon molten steel characterized in that vacuum degassing and decarburization treatment is carried out by blowing $CO_2$ gas into the molten steel from the lance and/or the twyer from the start of the vacuum degassing and decarburization treatment of the molten steel, and the $CO_2$ gas is switched to an Ar gas when the carbon concentration of the molten steel is between 150 and 50 (ppm).

5. In a vacuum degassing and decarburization treatment method for a molten steel using a vacuum treatment equipment provided with a lance and/or a twyer capable of blowing a gas into the molten steel and by blowing an Ar gas from the lance and/or the twyer, a production method for a low carbon molten steel characterized in that vacuum degassing and decarburization treatment of the molten steel is carried out by switching the Ar gas to be blown from the lance and/or the twyer to $CO_2$ gas for a certain predetermined period of time from the start of the vacuum degassing and decarburization treatment of the molten steel till the addition of a deoxidizing alloy to the molten steel, and after the deoxidizing alloy is added, the Ar gas is blown into the molten steel from the lance and/or the twyer.

6. In a vacuum degassing and decarburization treatment method for a molten steel using a vacuum treatment equipment provided with a lance and/or a twyer capable of blowing a gas into the molten steel and by blowing the gas from the lance and/or the twyer, a production method for a low carbon molten steel characterized in that vacuum degassing and decarburization treatment of the molten steel is carried out by blowing a $CO_2$ gas from the lance and/or the twyer from the start of the vacuum degassing and decarburization treatment of the molten steel till the addition of a deoxidizing agent to the molten steel, and after the addition of the deoxidizing agent, an Ar gas is blown into the molten steel from the lance and/or the twyer.

BEST MODE FOR CARRYING OUT THE INVENTION

In a method of conducting vacuum degassing and decarburizing treatment of a molten steel by blowing an Ar gas from a lance and/or a twyer, that is provided in a vacuum treatment equipment and can blow a gas into a molten steel, into the molten steel, the present invention relates to a method of economically, and moreover, without any troubles, producing a molten steel by partly replacing the expensive Ar gas by an economical gas.

The inventors of the present invention have examined the relationship between a $CO_2$ gas and a decarburization speed of a molten steel by conducting various experiments when the $CO_2$ gas is used as a gas for recirculating or stirring the molten steel inside an RH vacuum degassing vessel using vacuum degassing equipment.

Figure 1:
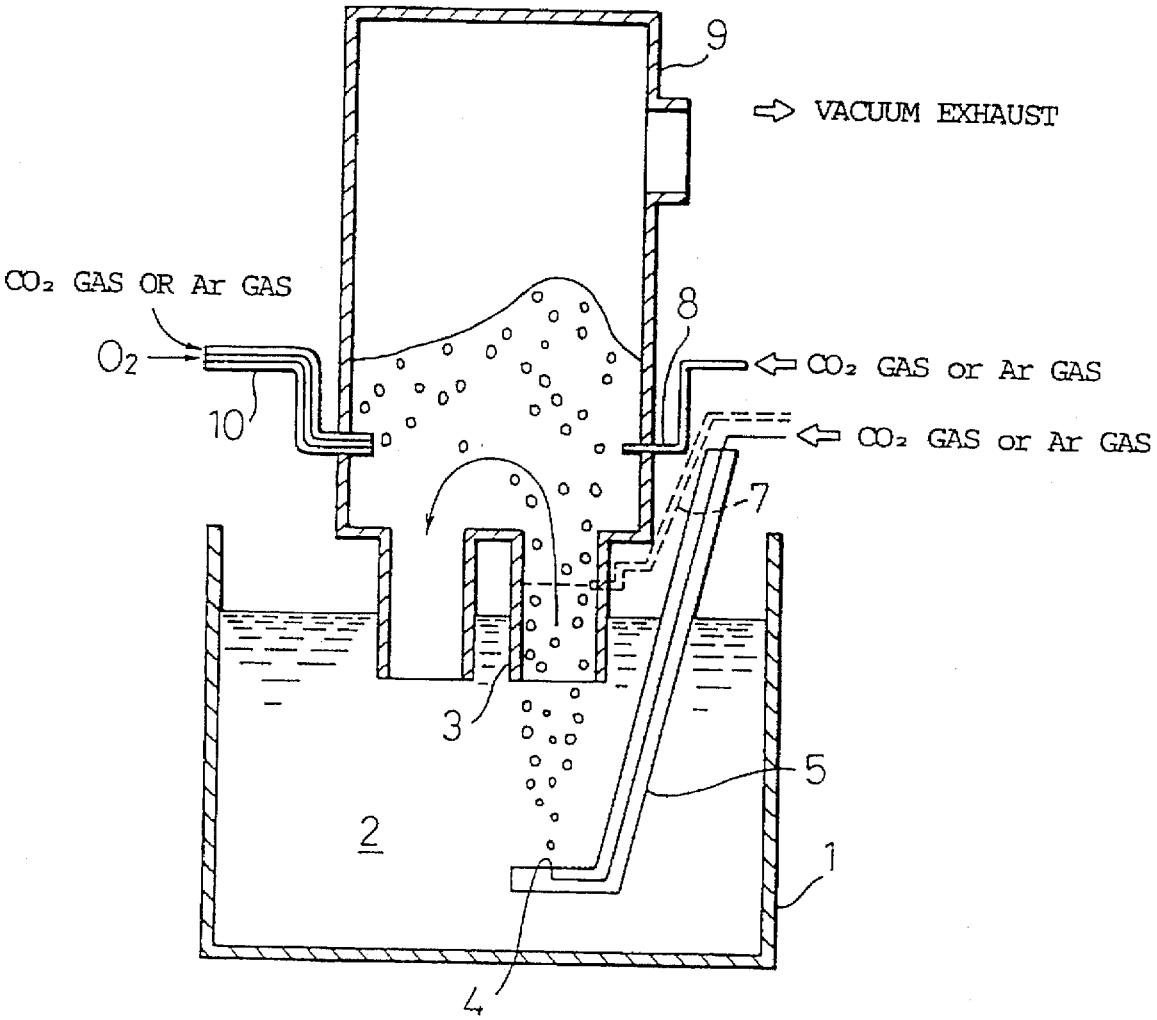
FIG. 1 is an explanatory view when a $CO_2$ gas is used as a gas for recirculating or stirring a molten steel inside an RH vacuum degassing vessel by using a vacuum degassing equipment.

As shown in FIG. 1, an immersion pipe 3 of an RH vacuum degassing vessel 9 is immersed into a molten steel 2 inside a molten steel ladle 1, and a $CO_2$ gas and an Ar gas are blown as gasses for recirculating the molten steel from an injection nozzle 4 of an injection lance 5 disposed at a lower part of this immersion pipe 3. Further, the Ar gas as a stirring gas is blown into the molten steel 2 from a stirring gas pipe 8 so as to recirculate the molten steel 2 inside the molten steel ladle 1, to stir the molten steel 2 and to decarburize it.

Figure 2:
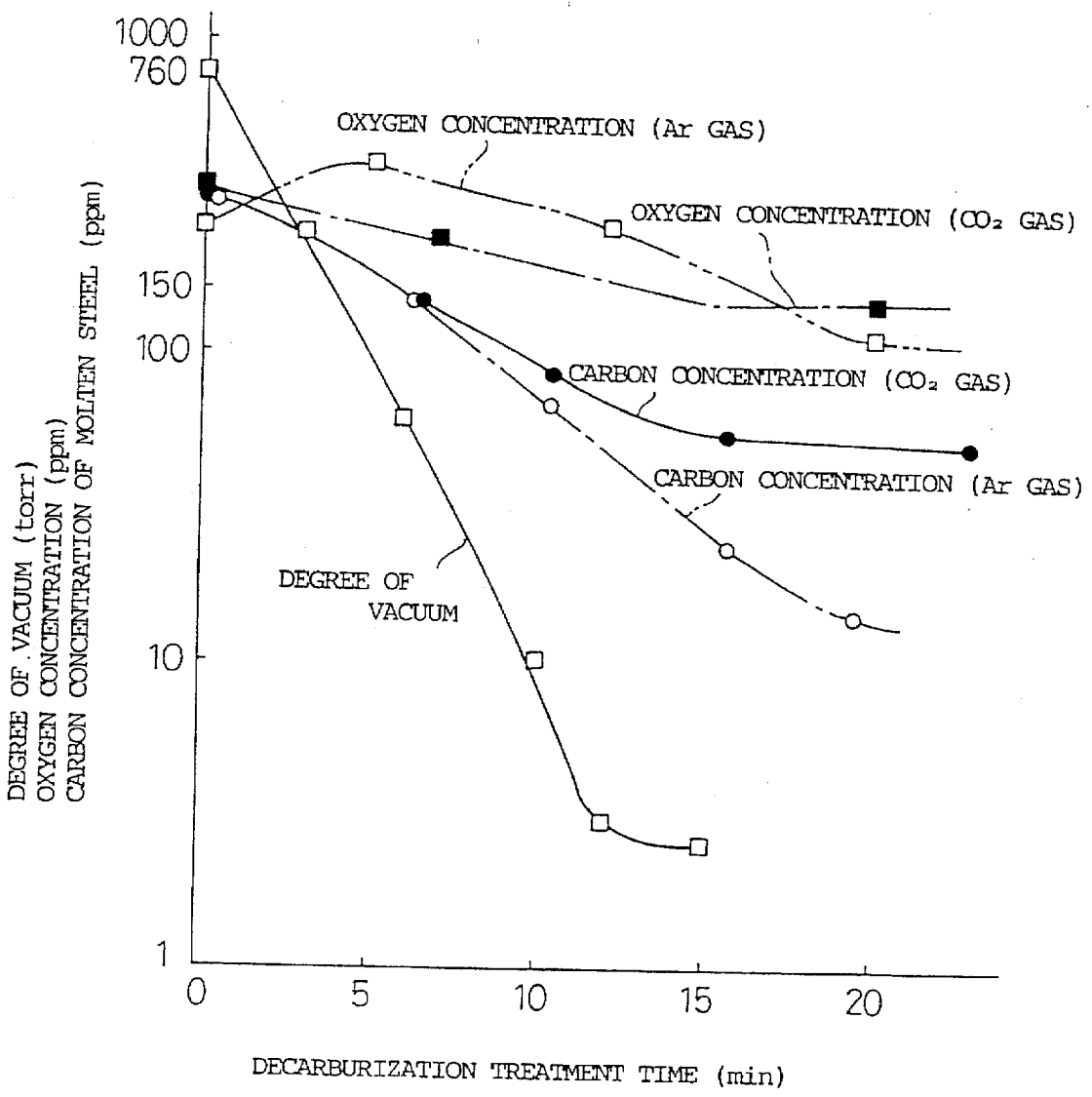
FIG. 2 is a diagram showing the relationship between a carbon concentration of the molten steel and a decarburization treatment time.

FIG. 2 shows the time shift of a carbon concentration (thick line) of the molten steel 2 in this instance. As a result, it has been found out that the decarburization speed drops when the $CO_2$ gas is blown in comparison with the case where the Ar gas is blown (one-dot-chain line) at the carbon concentration of the steel of 150 ppm, and that when the decarburization treatment is further continued by the $CO_2$ gas, the decarburization speed sequentially drops and stops at the carbon concentration of below about 50 (ppm). In other words, when the $CO_2$ gas is used, the decarburization reaction becomes slow between the carbon concentration of 150 and 50 (ppm) of the molten steel.

It is assumed that this drop of the reaction speed results from the thermal decomposition of the $CO_2$ gas blown, as expressed by the following formulas (1) and (2):

$$CO_2 \rightarrow CO + O \quad (1)$$

$$CO \rightarrow C + O \quad (2)$$

In other words, the blown $CO_2$ gas decomposes into C and O, and the resulting carbon (C) dissolves into the molten steel 2. When the carbon concentration of the molten steel 2 is relatively high from 150 to 300 (ppm), the quantity of C dissolved into the molten steel is relatively small, so that its influences hardly exists, and decarburization is quickly promoted in the same way as in the case of the Ar gas. When the carbon concentration reaches the ranges of 50 to 150 (ppm), its influence appears and the decarburization rate drops. When the carbon concentration of the molten steel 2 becomes about 50 (ppm), the dissolving quantity of C, resulting from the $CO_2$ gas, into the molten steel 2 balances the decarburization quantity, so that decarburization stops.

Accordingly, when the $CO_2$ gas is blown in place of the Ar gas for a certain period-of time from the start of the degassing treatment till the carbon concentration of the molten steel 2 reaches 50 (ppm) as stipulated by the second technical feature of the present invention, decarburization can be economically carried out to a desired carbon concentration without inviting the stop of decarburization.

Further, as stipulated by the third technical feature of the present invention, decarburization can be carried out more economically to a desired carbon concentration without inviting the stop of decarburization by blowing the $CO_2$ gas into the molten steel from the start of the degassing treatment so as to subject the molten steel to the vacuum degassing decarburization treatment and switching the gas from the $CO_2$ gas to the Ar gas before the carbon concentration of the molten steel 2 reaches 50 (ppm).

The gas cost becomes lower when switching of the gas is made at a lower carbon concentration between 50 and 150 (ppm), but the treatment time becomes longer as much as the lower concentration. Accordingly, when a long treatment time can be secured inside this RH vacuum degassing vessel 9, the $CO_2$ gas is preferably switched to the Ar gas before the carbon concentration reaches 50 (ppm) as stipulated by the third technical feature of the present invention, and when a long treatment time cannot be secured, the $CO_2$ gas is preferably switched to the Ar gas between the carbon concentration of 150 and 50 (ppm) as stipulated by the fourth technical feature of the present invention.

When the $CO_2$ gas is continuously blown even after the deoxidizing alloy is added into the molten steel 2, on the other hand, oxygen decomposed by the reactions represented by the reaction formulas (1) and (2) is dissolves into the molten steel 2, and a greater amount of the alloy must be added so as to remove this dissolved oxygen. As a result, the alloy cost increases. When the deoxidizing alloy such as Al or Si is added to the molten steel 2 before the carbon concentration of the molten steel 2 reaches 50 (ppm), therefore, it is preferred to blow the $CO_2$ gas before the deoxidizing alloy is added to the molten steel, and to blow the Ar gas after the deoxidizing alloy is added. By the way, a gas for protecting the lance or twyer, which is not immersed in the molten steel, before and after the vacuum treatment (before the start of exhaust and after completion of exhaust) may be $CO_2$ gas because it does not at all render any problem. Therefore, it is preferred to reduce the cost by using the $CO_2$ gas in place of the expensive Ar gas. After the $CO_2$ gas is switched to the Ar gas, the molten steel may be arbitrarily heated by adding the deoxidizing agent using Al or Si.

When the molten steel reflux gas is not blown from the injection nozzle 4 but is blown from the recirculating gas pipe 7 disposed in the immersion pipe 3 the same result can be obtained as when the gas is blown from the injection nozzle 4. When oxygen necessary for decarburizing the molten steel inside the vacuum treatment equipment is blown from the inner pipe and the Ar gas for cooling the inner pipe and the refractory around the inner pipe is simultaneously blown into the molten steel from the outer pipe of the double pipe the $CO_2$ gas is again blown in place of the Ar gas for a certain predetermined period of time at the stage where the carbon concentration of the molten steel is at least 50 (ppm). On the other hand, at the stage where the carbon concentration is below 50 (ppm), the Ar gas is exclusively used, and the $CO_2$ gas is blown preferably from the start of the decarburization treatment of the molten steel till the carbon concentration of the molten steel is from 150 to 50 (ppm). When the gas concentration is between 150 and 50 (ppm), the $CO_2$ gas is switched to the Ar gas. In this way, it has been found that decarburization can be conducted economically to a desired carbon concentration.

FIG. 1 shows the lance and the twyer when the Ar and $CO_2$ gasses are blown in the RH vacuum treatment equipment. In the drawing, reference numeral 7 denotes a gas blast twyer for recirculating the molten steel between the molten steel ladle 1 and the vacuum degassing vessel 9, reference numeral 8 denotes a gas blast twyer for stirring the molten steel, reference numeral 4 denotes a gas blast twyer for recirculating the molten steel between the molten steel ladle 1 and the vacuum degassing vessel 9, and reference numeral 10 denotes a double twyer for blowing oxygen necessary for decarburization from an inner pipe and for simultaneously blowing a gas for cooling the inner pipe and the refractory around the inner pipe from an outer pipe.

The application of the finding of the present invention is not particularly limited to the RH vacuum treatment equipment having two immersion pipes but can be similarly applied to a DH vacuum treatment equipment having one immersion pipe, and to the case where a ladle is disposed inside a vacuum pit and the molten steel inside the ladle is vacuum treated.

In the operation according to the present invention, it is further possible to arbitrarily add the operation of raising the temperature of the molten steel by adding Al and Si and supplying oxygen to them.

Hereinafter, the present invention will be explained in further detail with reference to Examples.

EXAMPLE

Example 1

A to-be-treated molten steel 2 inside a molten steel ladle 1 having a molten steel quantity of 340 (t) and a carbon concentration of 310 (ppm) was controlled and treated inside the RH vacuum degassing vessel 9 so that a final target vacuum inside the RH degassing vessel was not higher than 2 (torr).

Figure 3:
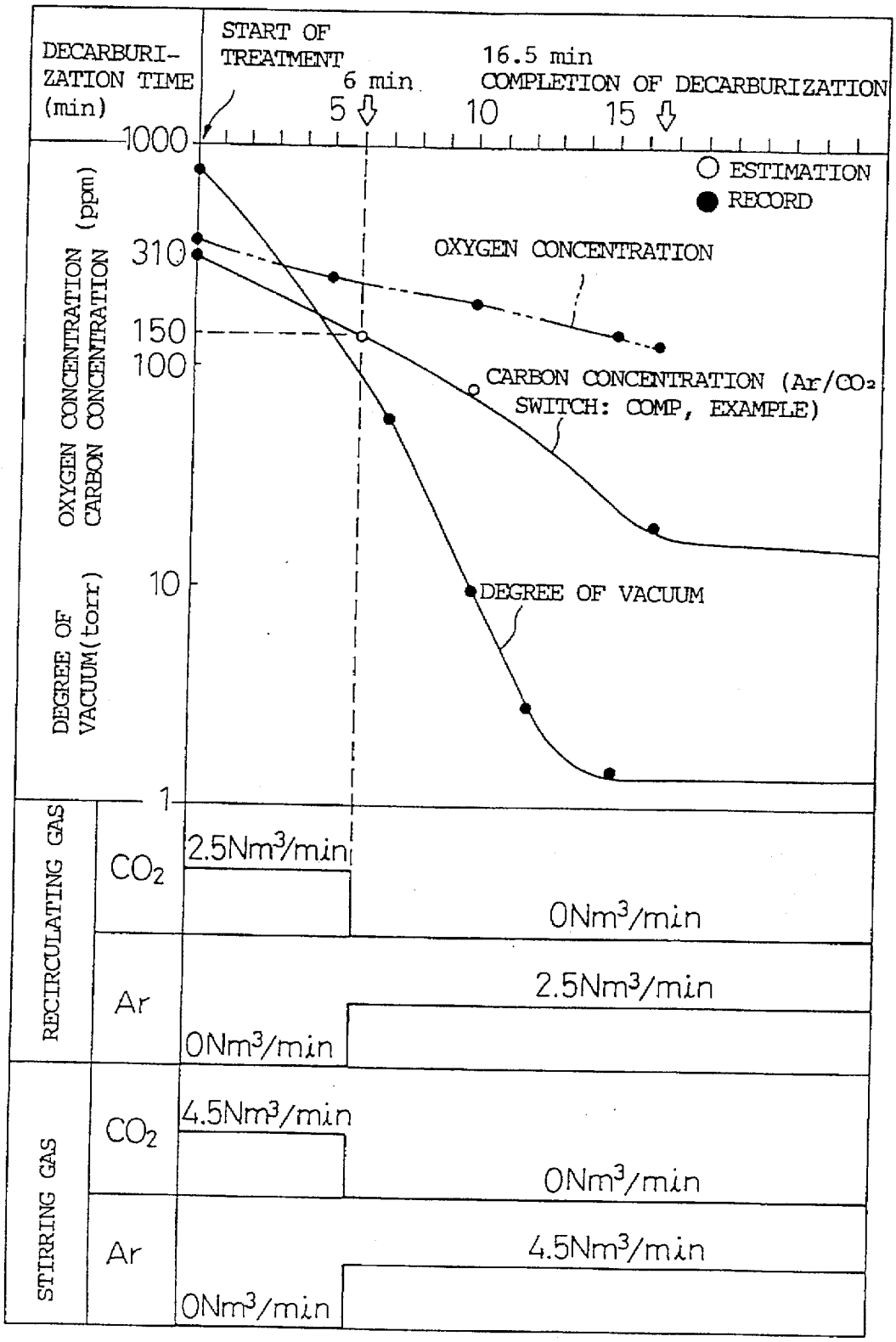
FIG. 3 is a diagram showing the relationship between the decarburization treatment time, the degree of vacuum, the oxygen concentration and the carbon concentration in Example 1.

At this time, treatment was started by using 2.5 (N $m^3$/min) of the $CO_2$ gas as the recirculating gas to be blown from the injection nozzle 4 and 4.5 (N $m^3$/min) of the $CO_2$ gas as the stirring gas to be blown from the stirring gas pipe 8 as shown in FIG. 3. Both of these $CO_2$ gases were switched to the Ar gas (in the same quantity as each of the $CO_2$ gas) at the time at which the carbon concentration of the treated molten steel 2 was estimated as 150 (ppm) (six minutes from the start of the treatment). As a Comparative Example, the operation was similarly carried out by blowing the same quantity of the Ar gas alone.

As a result, about 42 (N $m^3$) of the Ar gas could be replaced by the $CO_2$ without inviting the drop of the decarburization speed by the $CO_2$ gas, and the decarburization time was equal to that of the case where only the Ar gas used in the whole quantity. In the drawing, because the change of the carbon concentration was substantially the same for the present invention and Comparative Example, only one line is shown. The cost could be reduced by the quantity of the Ar gas replaced by the $CO_2$ gas.

By the way, the carbon concentration of the molten steel 2 was estimated in accordance with the following formulas (5) and (6) as disclosed in Japanese Unexamined Patent Publication (Kokai) No. 61-19726:

$$\ln\frac{C_1 - C_*}{C_o - C_*} = kt \tag{5}$$

where $C_1$: carbon concentration at treatment time t $C_0$: carbon concentration at start of treatment $C^*$: equilibrium carbon concentration k: decarburizing rate constant t: treatment time $$C_1=(C_0-C^*)\times\exp(-kt)+C. \tag{6}$$

Example 2

A to-be-treated molten steel 2 inside a molten steel ladle 1 having a molten steel quantity of 342 (t) and a carbon concentration of 320 (ppm) was controlled and treated inside the RH vacuum degassing vessel 9 shown in FIG. 1 so that a final target value of vacuum was not higher than 2 (Torr).

Figure 4:
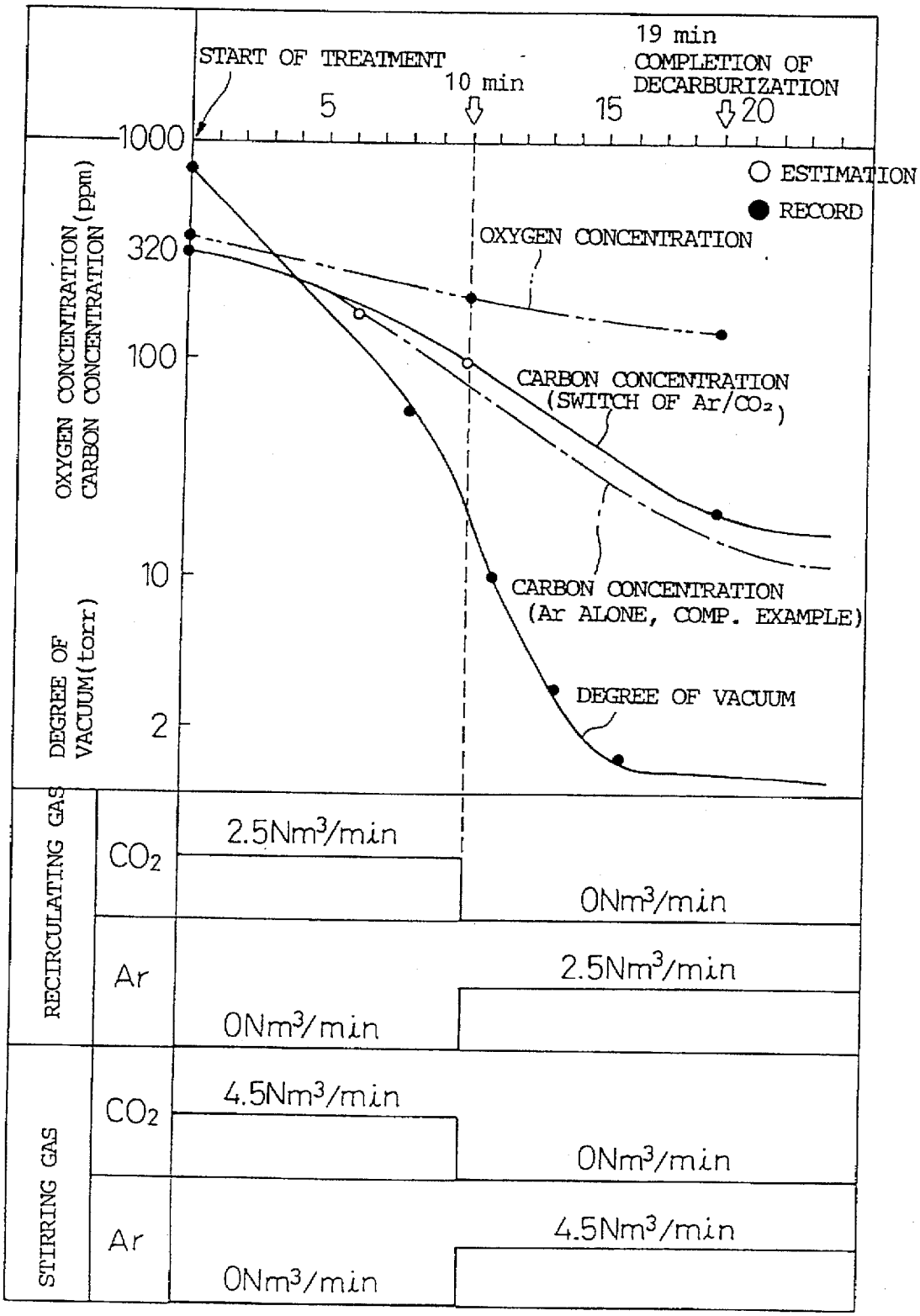
FIG. 4 is a diagram showing the relationship between the decarburization time, the degree of vacuum, the oxygen concentration and the carbon concentration in Example 2.

At this time, treatment was started by using 2.5 (N $m^3$/min) of the $CO_2$ gas as the recirculating gas to be blown from the injection nozzle 4 and 4.5 ($Nm^3$/min) of the $CO_2$ gas as the stirring gas to be blown from the stirring gas pipe 8 as shown in FIG. 4. Both of these $CO_2$ gases were switched to the Ar gas (in the same quantity as each of the $CO_2$ gases) at the time at which the carbon concentration of the treated molten steel 2 was estimated as 100 (ppm). As a Comparative Example, the operation was similarly carried out by blowing the same quantity of the Ar gas alone.

As a result, about 70 N $m^3$ of the Ar gas could be replaced by the $CO_2$ gas in comparison with the case where only the Ar gas was used, as represented by one-dot-chain line in FIG. 4, although the decarburization time was extended by two minutes.

Example 3

A to-be-treated molten steel 2 inside a molten steel ladle 1 having a molten steel quantity of 345 (t) and a carbon concentration of 303 (ppm) was controlled and treated inside the RH vacuum degassing vessel 9 shown in FIG. 1 so that a final target value of vacuum was not higher than 2 (Torr).

Figure 5:
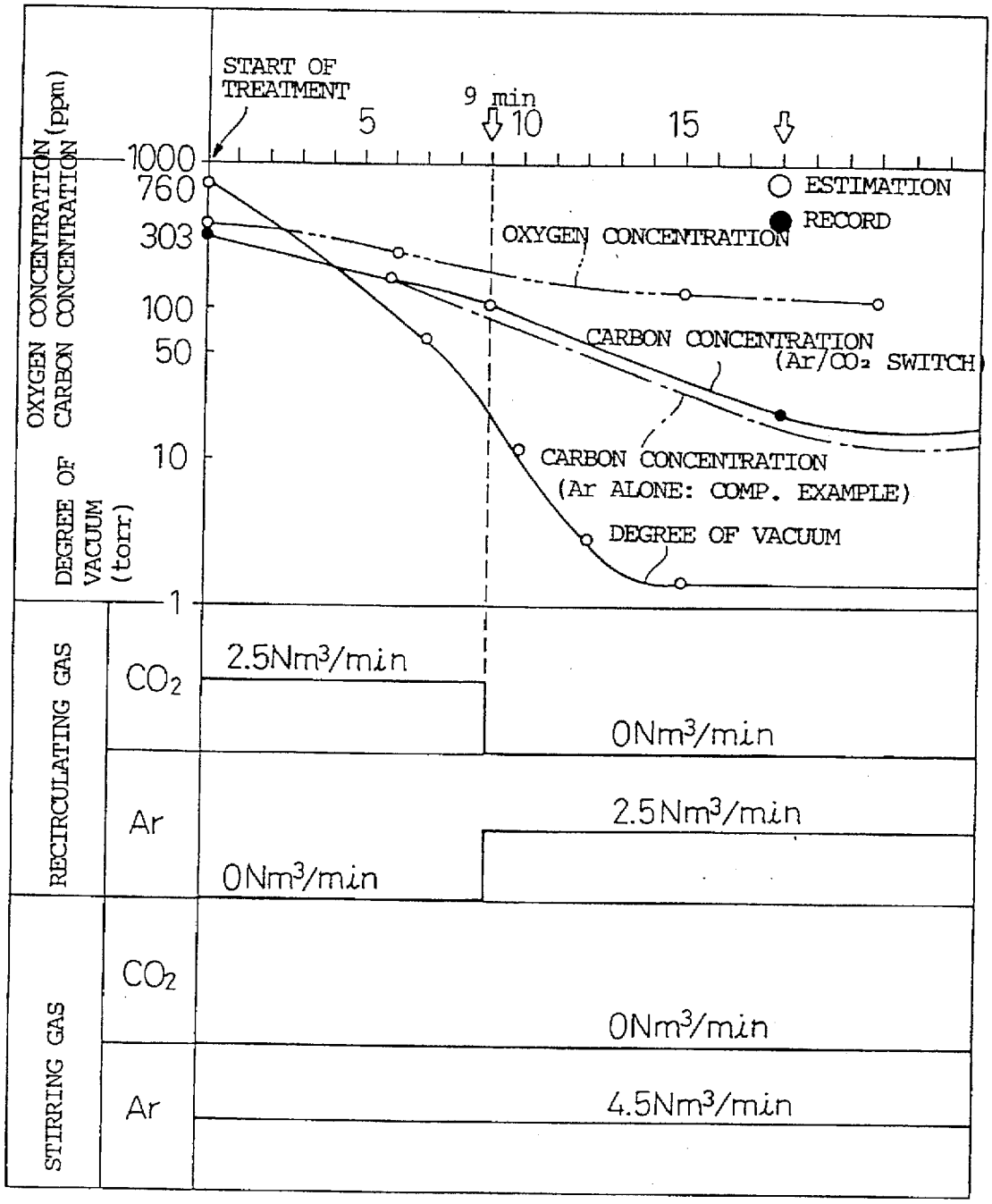
FIG. 5 is a diagram showing the relationship between the decarburization treatment time, the degree of vacuum, the oxygen concentration and the carbon concentration.

At this time, 2.5 ($Nm^3$/min) of the $CO_2$ gas was used as a recirculating gas to be blown from the injection nozzle 4 and 4.5 (N $m^3$/min) of the Ar gas was used as the stirring gas to be blown from the stirring gas pipe 8 and the treatment was started as shown in FIG. 5. The recirculating $CO_2$ gas to be blown from the injection nozzle 4 was switched to the Ar gas (in the same quantity as the $CO_2$ gas) at the time at which the carbon concentration of the treated molten steel 2 was estimated as 100 (ppm) (after 9 minutes from the start of the treatment). As a Comparative Example, the operation was similarly carried out by blowing the same quantity of the Ar gas alone.

As a result, about 22.5 ($Nm^3$) of the Ar gas could be replaced by the $CO_2$ gas in comparison with the case where only the Ar gas was used (one-dot-chain line in FIG. 5), although the decarburization time was extended by one minute.

Example 4

A to-be-treated molten steel 2 inside a molten steel ladle 1 having a molten steel quantity of 353 (t) and a carbon concentration of 313 (ppm) was controlled and treated inside the RH vacuum degassing vessel 9 shown in FIG. 1 so that a final target value of vacuum was not higher than 2 (Torr).

Figure 6:
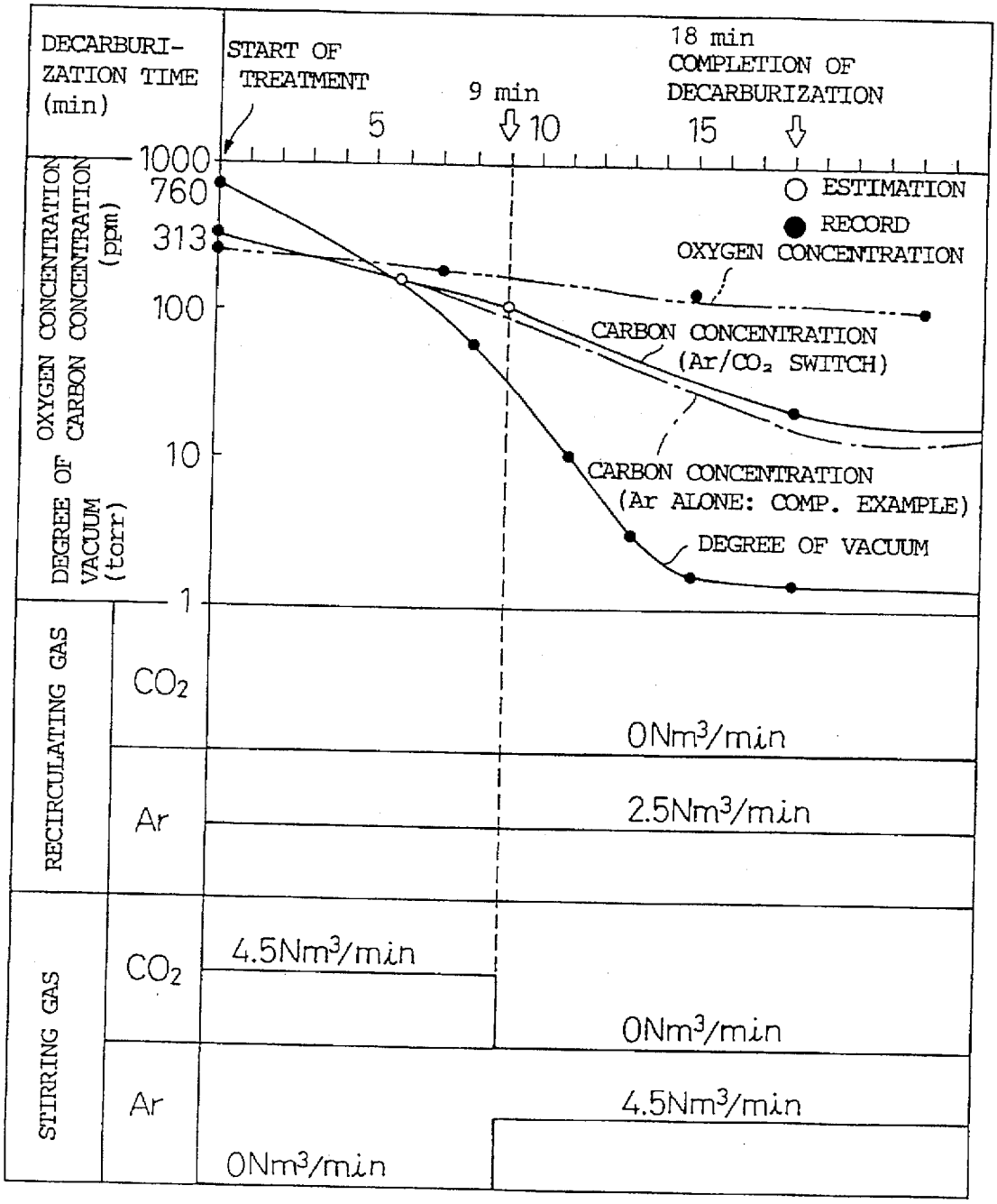
FIG. 6 is a diagram showing the relationship between the decarburization treatment time, the degree of vacuum, the oxygen concentration and the carbon concentration.

At this time, 2.5 ($Nm^3$/min) of the Ar gas was used as a recirculating gas to be blown from the injection nozzle 4 and 4.5 (N $m^3$/min) of the $CO_2$ gas was used as a stirring gas to be blown from the stirring gas pipe 8 and the treatment was started as shown in FIG. 6. The stirring $CO_2$ gas to be blown from the stirring gas pipe 8 was switched to the Ar gas (in the same quantity as the $CO_2$ gas) at the time at which the carbon concentration of the treated molten steel 2 was estimated as 100 (ppm) (nine minutes from the start of the treatment). As a Comparative Example, the operation was carried out similarly by blowing the same quantity of the Ar gas alone.

As a result, about 40.5 ($Nm^3$) of the Ar gas could be replaced by the $CO_2$ gas in comparison with the case where only the Ar gas was used (one-dot-chain line in FIG. 6), although the decarburization time was extended by 1.5 minutes.

Example 5

A to-be-treated molten steel 2 inside a molten steel ladle 1 having a molten steel quantity of 353 (t) and a carbon concentration of 560 (ppm) was controlled and treated inside the RH vacuum degassing vessel 9 shown in FIG. 1 so that a final target value of vacuum was not higher than 2 (Torr).

Figure 7:
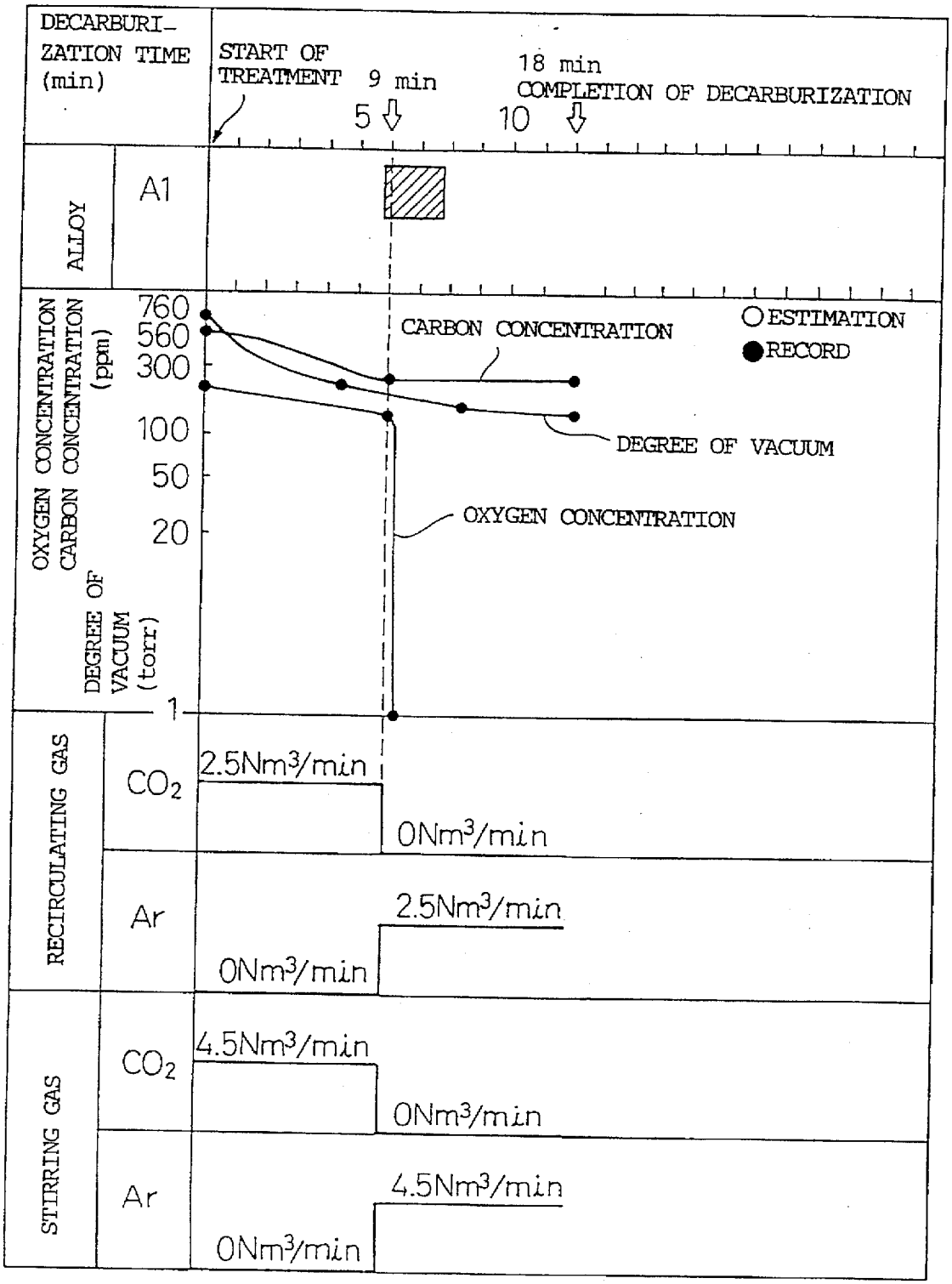
FIG. 7 is a diagram showing the relationship between the decarburization treatment time, the addition of alloys, the degree of vacuum, the oxygen concentration and the carbon concentration.
Figure 8:
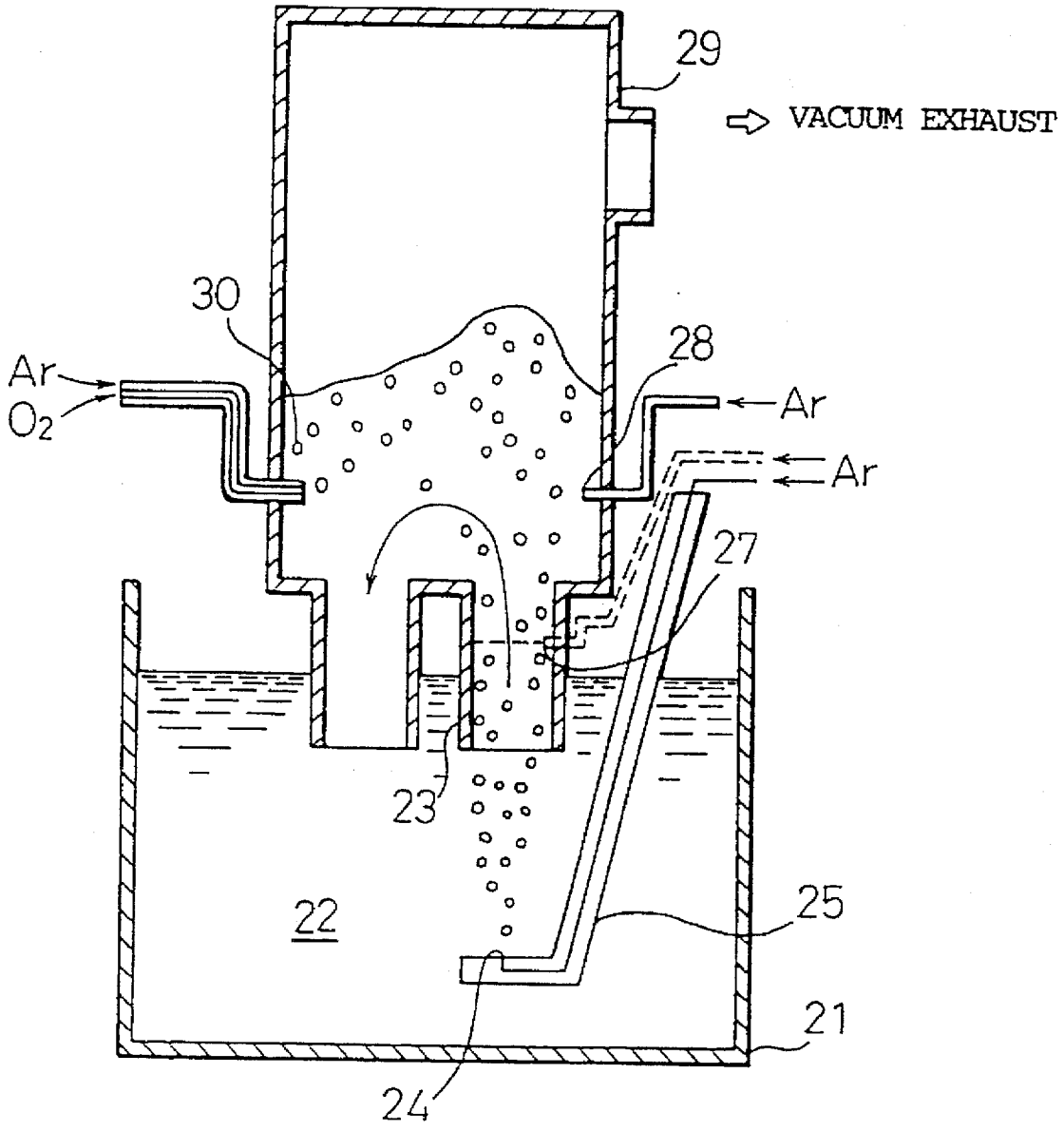
Fig. 8 PRIOR ART
FIG. 8 is an explanatory view of vacuum degassing and decarburization using a vacuum degassing equipment according to the prior art.

At this time, 2.5 ($Nm^3$/min) of the $CO_2$ gas was used as the recirculating gas to be blown from the injection nozzle 4 and 4.5 ($Nm^3$/min) of the $CO_2$ gas was used as the stirring gas to be blown from the stirring gas pipe and the treatment was started as shown in FIG. 7. The $CO_2$ gases blown from the injection nozzle 4 and from the stirring gas pipe 8 were switched to the Ar gas immediately before Al was added as a deoxidizing alloy (6 minutes from the start of the treatment).

As a result, the molten steel could be completely deoxidized by the same alloy feed quantity as when only the Ar gas was used, and about 42 ($Nm^3$/min) of the Ar gas could be replaced by the $CO_2$ gas without extending the RH degassing treatment time.

Industrial Applicability

As described above, the present invention uses the $CO_2$ gas as the recirculating gas and as the stirring gas from the start of the treatment, or for a predetermined period of time, and switches it to the Ar gas during the process in accordance with the carbon concentration of the molten steel or with the addition of the deoxidizing alloy. In this way, the present invention can execute the degassing treatment of the molten steel by using the more economical $CO_2$ gas and moreover, without inviting a stoppage of decarburization and an increase of the amount of addition of the deoxidizing alloy, and can reduce the gas cost of the vacuum treatment.

We claim:

1. A method for vacuum degassing and decarburization of a molten steel to produce a low carbon molten steel, said method comprising:

providing vacuum treatment equipment having a lance and/or a twyer for blowing a gas into the molten steel;

as an initial stage, blowing $CO_2$ gas into said molten steel through said lance and/or twyer;

carrying out a vacuum degassing and decarburization treatment of said molten steel by recirculating or stirring said molten steel using CO gas generated by decomposition of said $CO_2$ gas;

ascertaining carbon concentration of said molten steel and decarburization rate of said molten steel during said blowing of $CO_2$ gas into said molten steel;

switching blowing of $CO_2$ gas into said molten steel to blowing Ar gas into said molten steel through said lance and/or twyer as soon as carbon concentration of said molten steel reaches a selected reduced range whereby decarburization of said molten steel occurs at a slower rate.

2. A method for vacuum degassing and decarburization of a molten steel to produce a low carbon molten steel having a carbon concentration of not higher than 50 ppm carbon, said method comprising:

providing vacuum treatment equipment having a lance and/or a twyer for blowing a gas into the molten steel;

carrying out a vacuum degassing and decarburization treatment of said molten steel by blowing $CO_2$ gas into said molten steel through said lance and/or twyer when carbon concentration of said molten steel is higher than 50 ppm;

blowing only Ar gas into said molten steel through said lance and/or twyer when carbon concentration of said molten steel is not higher than 50 ppm.

3. A method for vacuum degassing and decarburization of a molten steel to produce a low carbon molten steel, said method comprising:

providing vacuum treatment equipment having a lance and/or twyer for blowing a gas into the molten steel;

carrying out a vacuum degassing and decarburization treatment of said molten steel by blowing $CO_2$ gas into said molten steel through said lance and/or twyer at start of said vacuum degassing and decarburization treatment;

switching blowing of $CO_2$ gas to blowing Ar gas into said molten steel through said lance and/or twyer when carbon concentration of said molten steel reaches 50 ppm.

4. A method for vacuum degassing and decarburization of a molten steel to produce a low carbon molten steel, said method comprising:

providing vacuum treatment equipment having a lance and/or twyer for blowing a gas into the molten steel;

carrying out a vacuum degassing and decarburization treatment of said molten steel by blowing $CO_2$ gas into said molten steel through said lance and/or twyer at start of said vacuum degassing and decarburization treatment;

switching blowing of $CO_2$ gas to blowing Ar gas into said molten steel through said lance and/or twyer when carbon concentration of said molten steel is between 150 and 50 ppm.

5. A method for vacuum degassing and decarburization of a molten steel to produce a low carbon molten steel, said method comprising:

providing vacuum treatment equipment having a lance and/or twyer for blowing a gas into the molten steel;

blowing Ar gas into said molten steel through said lance and/or twyer;

carrying out a vacuum degassing and decarburization treatment of said molten steel by switching blowing of said Ar gas to blowing $CO_2$ gas into said molten steel through said lance and/or twyer for a time period starting at commencement of said vacuum degassing and decarburization treatment;

adding a deoxidizing alloy to said molten steel at the end of said time period;

after adding said deoxidizing alloy to said molten steel, switching blowing of said $CO_2$ gas to blowing Ar gas into said molten steel through said lance and/or twyer.

6. A method for vacuum degassing and decarburization of a molten steel to produce a low carbon molten steel, said method comprising:

providing vacuum treatment equipment having a lance and/or twyer for blowing a gas into the molten steel;

carrying out a vacuum degassing and decarburization treatment of said molten steel by blowing $CO_2$ gas into said molten steel through said lance and/or twyer commencing at start of said vacuum degassing and decarburization treatment;

adding a deoxidizing agent to said molten steel during said vacuum degassing and decarburization treatment;

after adding said deoxidizing agent, switching blowing of said $CO_2$ gas to blowing Ar gas into said molten steel through said lance and/or twyer.

* * * * *